US008887416B2

(12) United States Patent
Ostermeyer

(10) Patent No.: US 8,887,416 B2
(45) Date of Patent: Nov. 18, 2014

(54) ATTACHMENT FOR CONSTRUCTION EQUIPMENT

(75) Inventor: Thomas Ostermeyer, Biberach (DE)

(73) Assignee: Imbolex Engineering GmbH, Biberach (DE)

( * ) Notice: Subject to any disclaimer, the term of this patent is extended or adjusted under 35 U.S.C. 154(b) by 453 days.

(21) Appl. No.: 13/254,879

(22) PCT Filed: Mar. 5, 2010

(86) PCT No.: PCT/EP2010/001390

§ 371 (c)(1),
(2), (4) Date: Nov. 17, 2011

(87) PCT Pub. No.: WO2010/099980

PCT Pub. Date: Sep. 10, 2010

(65) Prior Publication Data

US 2012/0126559 A1 May 24, 2012

(30) Foreign Application Priority Data

Mar. 6, 2009 (DE) ..... 10 2009 012 050

(51) Int. Cl.
*E02F 3/96* (2006.01)

(52) U.S. Cl.
CPC ..... *E02F 3/965* (2013.01)
USPC ..... 37/406; 37/468

(58) Field of Classification Search
USPC ..... 37/403, 406, 468; 172/272
See application file for complete search history.

(56) References Cited

U.S. PATENT DOCUMENTS 4,726,731 A * 2/1988 Jones ..... 414/723
4,838,493 A * 6/1989 LaBounty ..... 241/101.73

(Continued)

FOREIGN PATENT DOCUMENTS

AT 77670 11/1988
DE 4109783 3/1991

(Continued)

OTHER PUBLICATIONS

International Search Report for PCT/EP2010/001390 mailed Jun. 18, 2010.

*Primary Examiner* — Robert Pezzuto
*Assistant Examiner* — Joan D Misa
(74) *Attorney, Agent, or Firm* — Wood, Herron & Evans, LLP

(57) ABSTRACT

The invention relates to an attachment (14), in particular for construction equipment, comprising a frame (16) that can be attached via a coupling unit (21) to an implement (10) or an equipment carrier (12) of an implement (10); a tool (18) having two tool parts (22, 23); a joint (26) that is provided on the frame (16) and has a pin (28) on which the tool parts (22, 23) of the tool (18) can be pivotably mounted relative to one another; and a tool drive (20) attached to the frame (16) for moving at least one of the tool parts (22, 23) relative to the frame (16). Furthermore, the tool drive (20) is connected to the frame (16) via at least one first link device (34), and is connected to the tool parts (22, 23) via at least one second link device (36). For a quick and easy tool change, the tool parts (22, 23) are detachably connected to the tool drive (20) via the at least second link device (36) on the one hand, and on the other hand, the pin (28) of the joint (26) can at least partially be removed from the joint (26) due to a pin drive (42) provided on the frame (16) in order to be able to remove the tool parts (22, 23) from the joint (26).

14 Claims, 9 Drawing Sheets

(56) References Cited

U.S. PATENT DOCUMENTS

| | | | | | |
|---|---|---|---|---|---|
| 4,934,462 | A | | 6/1990 | Tatara et al. | |
| 5,044,569 | A | | 9/1991 | LaBounty et al. | |
| 5,060,378 | A | | 10/1991 | LaBounty et al. | |
| 5,062,227 | A | * | 11/1991 | De Gier et al. | 37/406 |
| 5,145,313 | A | * | 9/1992 | Weyer | 414/723 |
| 5,242,258 | A | * | 9/1993 | Weyer | 414/723 |
| 5,533,682 | A | * | 7/1996 | de Gier et al. | 241/101.73 |
| 5,546,683 | A | * | 8/1996 | Clark | 37/468 |
| 5,562,397 | A | * | 10/1996 | Albright | 414/723 |
| 5,692,325 | A | * | 12/1997 | Kuzutani | 37/468 |
| 5,802,753 | A | * | 9/1998 | Raunisto | 37/468 |
| 5,822,893 | A | * | 10/1998 | Ostermeyer | 37/406 |
| 6,241,455 | B1 | * | 6/2001 | Schupback et al. | 414/723 |
| 6,332,747 | B1 | * | 12/2001 | Lee | 414/723 |
| 6,655,054 | B1 | * | 12/2003 | Ward | 37/406 |
| 6,994,284 | B1 | * | 2/2006 | Ramun | 241/266 |
| 7,000,339 | B1 | * | 2/2006 | Ramun | 37/406 |
| 7,014,385 | B2 | * | 3/2006 | Lim et al. | 403/322.4 |
| 7,108,211 | B2 | * | 9/2006 | Ramun | 241/266 |
| 7,121,489 | B2 | * | 10/2006 | Ramun | 241/266 |
| 7,237,738 | B2 | * | 7/2007 | Kimura et al. | 241/101.73 |
| 7,284,718 | B2 | * | 10/2007 | Christenson | 241/101.73 |
| 7,412,788 | B2 | * | 8/2008 | Schipp et al. | 37/468 |
| 7,954,742 | B2 | * | 6/2011 | Ramun et al. | 241/101.71 |
| 7,984,575 | B2 | * | 7/2011 | Robl et al. | 37/468 |
| 8,245,964 | B2 | * | 8/2012 | Ramun | 241/101.73 |
| 8,424,789 | B2 | * | 4/2013 | Ramun | 241/101.73 |
| 2006/0237204 | A1 | | 10/2006 | Rastegar et al. | |
| 2007/0001041 | A1 | * | 1/2007 | Christenson | 241/101.73 |

FOREIGN PATENT DOCUMENTS

| | | | |
|---|---|---|---|
| DE | 4102370 | | 8/1991 |
| DE | 9209675 | U1 | 11/1993 |
| DE | 9408196 | U1 | 8/1994 |
| DE | 69526722 | | 2/1995 |
| DE | 4417401 | A1 | 11/1995 |
| DE | 29708705 | U1 | 7/1997 |
| DE | 19832699 | | 6/1999 |
| DE | 60311700 | | 2/2003 |
| DE | 10200836 | A1 | 7/2003 |
| EP | 0641618 | A1 | 3/1995 |
| EP | 1605104 | | 12/2005 |
| FR | 2822482 | | 3/2001 |
| JP | 2001288769 | | 10/2001 |
| WO | WO-9602708 | A1 | 2/1996 |
| WO | WO-9730232 | A1 | 8/1997 |
| WO | WO 01/68992 | | 9/2001 |

* cited by examiner

ATTACHMENT FOR CONSTRUCTION EQUIPMENT

The present invention relates to an attachment, particularly an attachment for construction machines.

Construction machines generally have an implement, such as an excavator for example, which is fitted with an equipment carrier, for example in the form of a swivel arm. Various attachments which are suitable for carrying out different tasks can be fitted to this equipment carrier. For this purpose, conventional attachments have a frame which can be attached by means of a coupling unit to the equipment carrier and on which a certain tool is provided. In addition, a tool drive is provided on the frame for the tool.

On construction sites various tasks which place different requirements on the tools frequently have to be carried out. For example, in the case of demolition work, various structures (steel beams, concrete slabs) are broken and/or cut, for which different tool characteristics are required. Different solutions have already been disclosed for dealing with changing demands on tools on a construction site.

For example, WO 96/02708 A1 describes a pair of concrete breaking pliers with two jaws, each having concrete-breaking sections and cutters in order to separate the concrete-breaking and cutting function and thus to optimize the respective tool components for their functionalities. WO 97/30232 A1 shows a pair of concrete-breaking pliers with a first pair of jaws which is designed for breaking concrete slabs and a second pair of jaws which is designed for cutting steel beams. Tools of this kind with multiple functions (in this case, breaking of concrete slabs and cutting of steel beams) reduce the number of tools and attachments to be held available.

Furthermore, so-called quick-change devices exist, with which a rapid replacement of the complete attachment on an implement or on its equipment carrier can be carried out. Such quick-change devices enable stoppage times on construction sites to be reduced and therefore the work to be carried out more effectively and more economically. Such quick-change devices for attachments are disclosed, for example, in the documents DE 102 00 836 A1, DE 44 17 401 A1, DE 94 08 196 U1 and DE 92 09 675 U1, wherein these quick-change devices are in each case matched to special kinds of attachment.

The system described above where the whole attachment is changed has the disadvantage that a dedicated attachment must be held available for every task and also the whole attachment has to be removed in order to replace wearing parts of the tools for example. This ultimately leads to a large fleet of machines with correspondingly high storage outlay, logistics outlay and cost outlay. In order to reduce the number of attachments to be held available, it is therefore also known not to change the whole attachment but only the tool which is fixed thereto.

DE 297 08 705 U1 discloses a demolition device with two tool jaws which can be pivoted relative to one another and which are connected to one another as a constructional unit by means of a pivoting bearing. In order to remove the tool jaws from the frame, the two retaining devices of the first fixed jaw and the fixing between the second movable jaw and its drive apparatus are released, as a result of which the two jaws, which continue to be joined to one another by means of the pivoting bearing, can be removed from the attachment frame. This demolition device is a development of EP 0 641 618 B1, in which the pivoting bearing between the two tool jaws is additionally detachably fixed to the attachment frame.

It is true that the last-mentioned attachments with replaceable tools lead to a reduction in the fleet of machines, as only the tools themselves and not the complete attachments need to be held available in large numbers, however the disadvantage of this solution is the relatively elaborate and difficult tool change itself, which still leads to long stoppage times on construction sites.

An object of the present invention is to create an improved attachment with which a simple and rapid tool change is possible.

This object is achieved by an attachment with the characteristics of claim 1. Advantageous embodiments and improvements are the subject matter of the dependent claims.

The attachment according to the invention has a frame which can be attached via a coupling unit to an implement or to an equipment carrier of an implement; a tool having two tool parts; a joint that is provided on the frame and has a pin on which the tool parts of the tool can be pivotably mounted relative to one another; and a tool drive attached to the frame for moving at least one of the tool parts relative to the frame, wherein the tool drive is connected to the frame via at least one first link device, and is connected to the tool parts via at least one second link device. Furthermore, the two tool parts are detachably connected to the tool drive via the at least one second link device and the pin of the joint can at least partially be removed from the joint by a pin drive provided on the frame in order to be able to remove the tool parts from the joint.

According to the invention, it is provided that a) the two tool parts are detachably connected to the tool drive via the at least one second link device, and b) the pin of the joint can at least partially be removed from the joint by a pin drive provided on the frame in order to be able to remove the tool parts from the joint. As a result of these two measures, the tool with the two tool parts can be removed from the frame of the attachment in that, on the one hand, the connection between the tool parts and the tool drive via the at least one second link device is removed and, on the other, the pin is at least partially removed from the joint provided on the frame. As the removal of the pin takes place by means of a pin drive provided on the frame, i.e. does not have to be carried out manually, the tool change can be carried out more easily and more quickly than with conventional attachments.

The frame of the attachment describes the base frame of the attachment which, on the one hand, can be connected to the implement and, on the other, carries all components of the attachment, in particular the tool and the tool drive. It is not restricted to a frame shape in the narrower sense, but can also assume housing shapes, skeleton shapes and the like.

The inventive design of the attachment can advantageously be used for all kinds of tools that have two tool parts which can be moved relative to one another (grippers, jaws, pliers, etc.). Examples of suitable attachments with which the invention can be used are demolition and scrap shears, demolition and scrap pliers, concrete-breaking pliers, combi-pliers, pulverizers, demolition and sorting grippers and the like.

In an embodiment of the invention, the pin of the joint is formed by a plurality of pin parts which are detachably connected to one another in the longitudinal direction of the pin, of which at least one pin part can be removed from the joint by the pin drive. Preferably, at least two pin parts of the pin can be removed from the joint by the pin drive. By dividing the pin into a plurality of pin parts, the pin drive for removing the pin from the joint can be made smaller. For example, the pin drive can have at least two drive elements which are designed for removing two pin parts of the pin from the joint in opposing directions.

The pin drive can be in the form of a hydraulic pin drive or an electric-motor-driven pin drive, for example. A combination of a plurality of drive types is also conceivable here.

In a preferred embodiment, a supply and/or control of the pin drive can be in the form of a supply or control of the drive of the attachment and/or the tool drive. Furthermore, in this case, a switch element is provided for switching over the supply or control; however it is not necessary to retrospectively modify the supplies and/or controls (e.g. hydraulic system) of the implement and the equipment carrier. As the attachment does not have to be turned during a tool change, for example, the hydraulic system of the attachment drive can be used to turn the pin drive.

In order to guarantee that the tool is securely fixed while the attachment is operating, it is an advantage when the detachable pin or detachable pin parts of the pin is/are pre-stressed in their position(s) in order to retain the tool parts. In addition or only as an alternative, the detachable pin or detachable pin parts can be lockable in their position(s) in order to retain the tool parts.

In a further embodiment of the invention, the at least one second link device of the tool drive can be connected to the joint via at least one lever. This lever effects a guiding of the movement of the second link device which is coupled to the tool parts.

This at least one lever can be designed to be rigid or also adjustable in length, for example. In the case of the adjustable-length lever, a supply and/or control of the drive for changing the length of the lever can be formed, for example, by a supply or control of the drive of the attachment and/or the tool drive. The drives are changed over, for example, in parallel with the changeover operation for the pin drive. In addition, play between the first and second engagement elements of the second link devices, which can occur over the course of time, can be compensated for by an adjustable-length lever.

In a further embodiment of the invention, the at least one second link device of the tool drive can have a first engagement element provided on the tool drive and a second engagement element provided on a tool part, which element detachably engages with the first engagement element.

In an embodiment, the one element of the first and second engagement element can be designed as a hook-shaped engagement element and the other element of the first and second engagement element can be designed as a bar-shaped engagement element which can be removed from the hook-shaped engagement element perpendicular to its longitudinal direction. In another embodiment, the one element of the first and second engagement element can be designed as a cylindrical engagement element and the other element of the first and second engagement element can be designed as a pin-shaped engagement element which can be removed from the cylindrical engagement element in its longitudinal direction.

For easy tool changing, the tool drive, the pin drive and/or the drive for changing the length of the adjustable-length lever can be designed to effect a relative movement between the first and the second engagement element.

The above and other characteristics, advantages and possible applications of the attachment according to the invention will be better understood from the following description of a preferred, non-restrictive exemplary embodiment with reference to the attached drawings. In the drawings.

Figure 1:
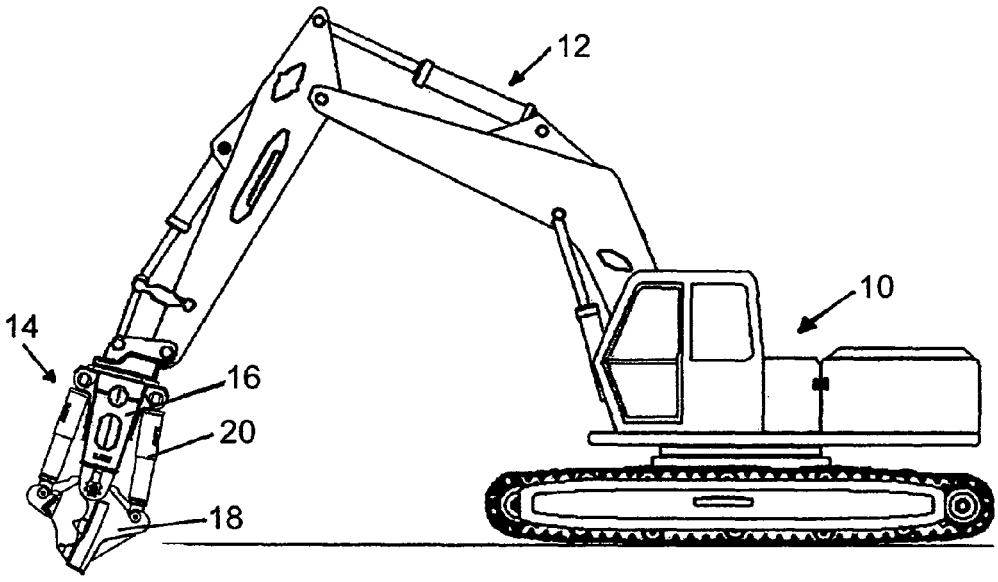
FIG. 1 shows a highly schematized side view of a construction machine with an attachment with attached tool.

FIG. 1 shows first of all, by way of example, a construction machine with an implement 10, for example in the form of an excavator. An attachment 14 is fixed to the implement 10 by means of an equipment carrier 12 (e.g. swivel arm, jib etc.). The attachment 14 contains a frame 16, a tool 18 attached to the frame 16, and a tool drive 20 attached to the frame 16 for actuating the tool 18.

In addition, a hydraulic system, which is connected by means of hydraulic pipes fed along the equipment carrier 12 to the hydraulic tool drive 20 (for moving the tool) and to a hydraulic attachment drive (for rotating the attachment about its longitudinal axis), is provided on the implement 10 in the usual manner. The attachment is attached to the equipment carrier 12 by means of the coupling unit, which also makes a connection to the appropriate hydraulic pipes.

Figure 2:
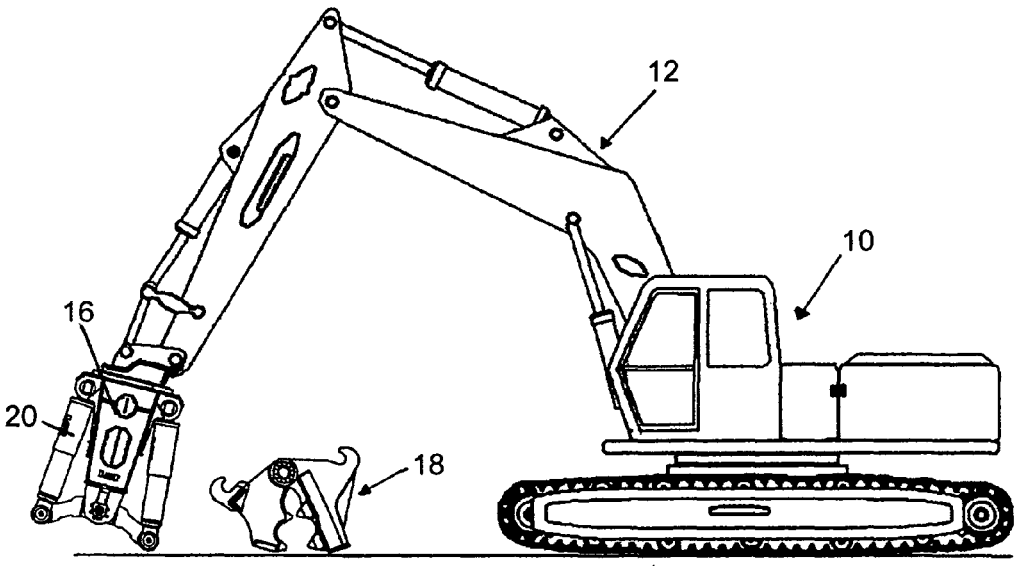
FIG. 2 shows a highly schematized side view of the construction machine of FIG. 1 with separate tool.

As shown in FIG. 2, the attachment 14 is designed so that the tool 18 can be removed from the frame 16 and the tool drive 20 of the attachment 14. This enables the attachment to be quickly matched to the different tasks to be carried out directly on site in order to reduce the stoppage times without having to provide a large fleet of machines with a high number of different complete attachments.

In addition, the frame 16 and therefore the complete attachment 14 can of course also be removed from the equipment carrier 12 if required.

The design of the attachment will now be explained in more detail with reference to FIG. 3 to 6. By way of example, the attachment shown in the figures is equipped with a pair of concrete-breaking pliers as a tool. Other types of tool can of course also be used with the attachment according to the invention. Purely by way of example, demolition and scrap shears, demolition and scrap pliers, combi-pliers, pulverizers and demolition and sorting grippers are mentioned in this regard.

Figure 3:
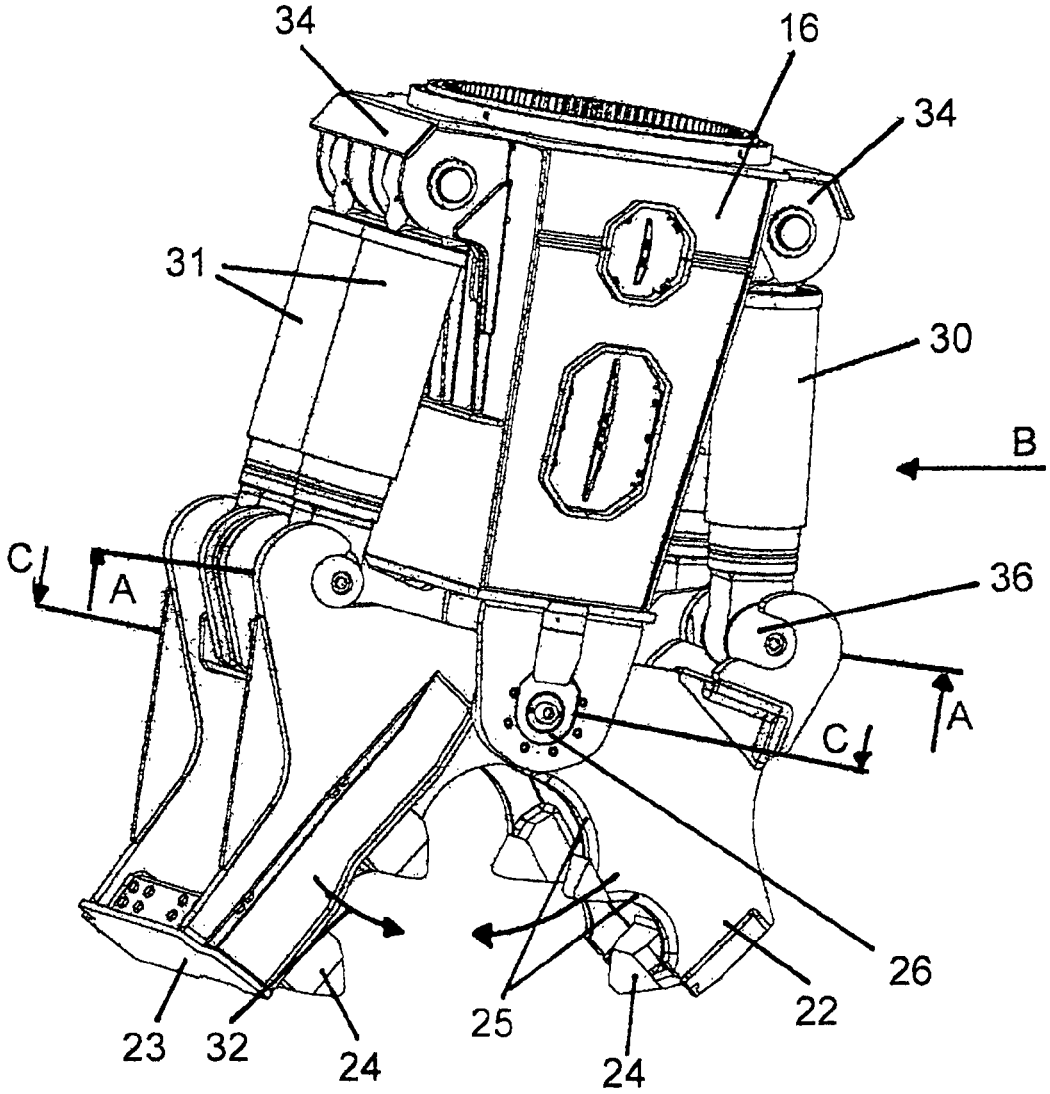
FIG. 3 shows a schematic perspective view of an attachment according to an exemplary embodiment of the invention.
Figure 4:
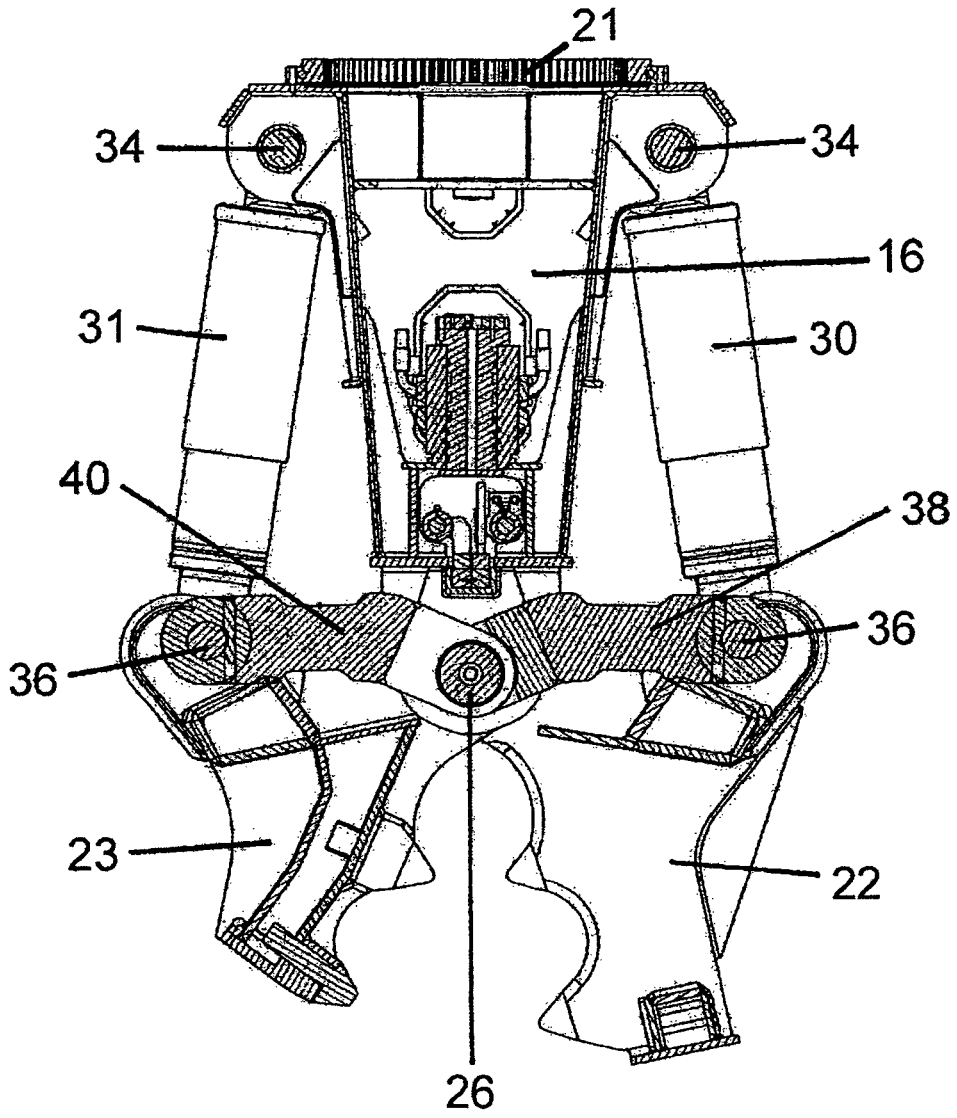
FIG. 4 shows a schematic section view of the attachment of FIG. 3 along the line A-A in FIG. 3.

As can best be seen in FIGS. 3 and 4, the frame 16 serves as a carrier for the respective tool 18 and the corresponding tool drive 20. At its end region facing the equipment carrier 12, the frame 16 is designed with a coupling unit 21 in order to attach the frame 16 to the equipment carrier 12 in a detachable manner. This coupling unit 21 serves both as the mechanical connection between the frame 16 and the equipment carrier 12, and the connection of the tool drive 20 and other drives to the drive system of the implement 10. This is usually a hydraulic system.

The tool 18 essentially comprises two tool parts 22 and 23, which in the present case are designed as plier jaws of a pair of concrete-breaking pliers. The two plier jaws 22, 23 are in each case designed with a plurality of tooth-shaped concrete-breaking sections 24 and a plurality of cutters 25 so that the concrete-breaking pliers 18 can be used both for breaking concrete slabs and also for cutting steel beams. An example of a possible design of such a pair of concrete-breaking pliers 18 is described in more detail in the already mentioned WO 96/02708 A1.

At its end region facing the tool 18, the frame 16 has a substantially centrally arranged joint 26. This joint 26 contains a multi-part pin 28, which will be described later in more detail and to which the two plier jaws 22, 23 are mounted so that they can be pivoted relative to one another. This means that either both plier jaws 22, 23 can be pivoted about the joint 26, or only one of the two plier jaws 22, 23 can be pivoted about the joint 26 while the other is attached rigidly to the frame 16.

The tool drive 20 for this tool 18 has a plurality of lifting cylinders 30, 31. Two first lifting cylinders 30 are in each case connected via a first link point 34 to the frame 16 and detachably coupled via a second link point 36 to the first tool part 22. In a similar manner, two second lifting cylinders 31 are in each case connected via a first link point 34 to the frame 16 and detachably coupled via a second link point 36 to the first tool part 23. When the lifting cylinders 30, 31 are actuated, i.e. their piston rods are extended, then the two plier jaws 22, 23 are pivoted towards one another about the joint 26 as shown by the arrows 32 in FIG. 3.

If, for example, the second tool part 23 is to be rigidly fixed to the frame 16, then rigid retaining devices are used instead of the second lifting cylinder 31. These rigid retaining devices are however likewise provided with a second link device 36 which enables the second tool part 23 to be removed. Furthermore, only one lifting cylinder 30, 31 in each case or more than two lifting cylinders 30, 31 can of course also be used. The invention is also not restricted to hydraulic lifting cylinders; basically other tool drives 20 can also be used.

In order to guide the pivoting movement of the two plier jaws 22, 23 about the joint 26 on the frame 16, the two link devices 36 are additionally connected to the central joint 26 by means of levers 38, 40. The levers 38, 40 are designed, for example, in the form of toggle levers as shown in FIG. 4. In the case of a rigidly fixed tool part 23, the appropriate lever 40 serves as a stable support for the second link device 36.

The design and principle of operation of the joint 26 of the attachment 14 and of the second link device 36 are shown in more detail in FIGS. 6 and 7 in different views and different operating states of the attachment 14.

The joint 26 of the attachment 14 attached to the frame 16 is formed in particular by a multi-part pin 28 which is attached to the frame 16 and fixed to rotate therewith. In the present exemplary embodiment, the pin 28 is made up of three pin parts, namely a middle pin part 28*a* and two outer pin parts 28*b* which are arranged behind one another in the longitudinal direction of the pin (e.g. left/right direction in FIG. 5B) and connected to one another. For this purpose, the middle pin part 28*a* has a recess on each of its two face sides, for example, in which the face sides of the outer pin parts 28*b* are inserted, as can best be seen in FIG. 5B. The altogether three pin parts 28*a*, 28*b* are preferably designed and arranged symmetrically.

Figure 5B:
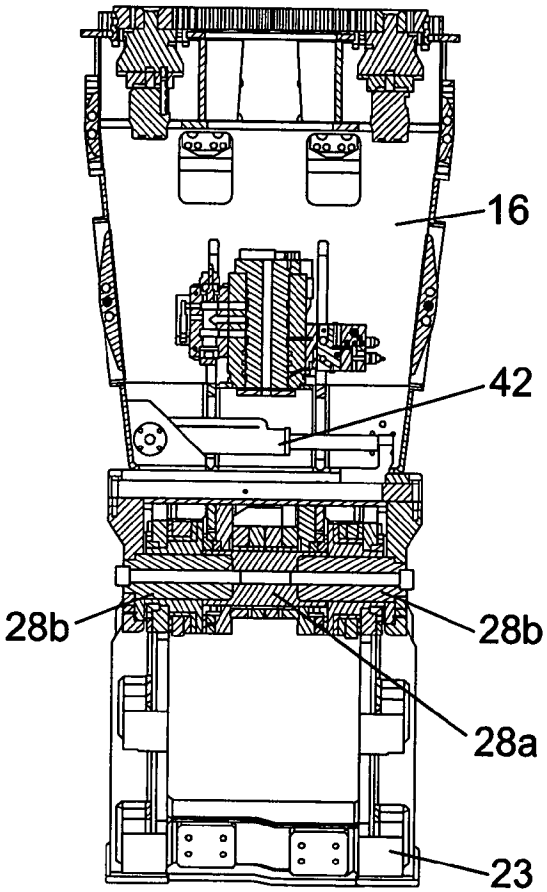
FIG. 5B shows a schematic section view of the attachment of FIG. 3 along the line C-C in FIG. 3 with retracted pin parts.
Figure 6B:
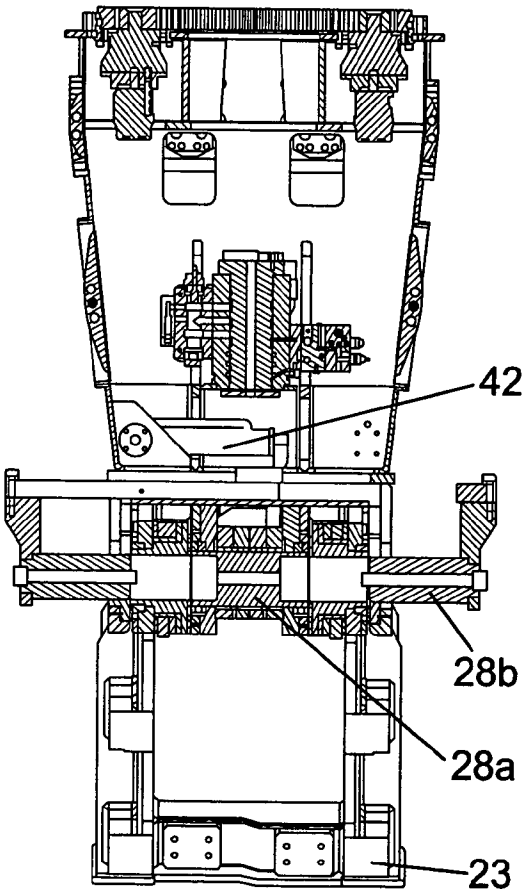
FIG. 6B shows a schematic section view of the attachment of FIG. 3 along the line C-C in FIG. 3 with extended pin parts.
Figure 6A:
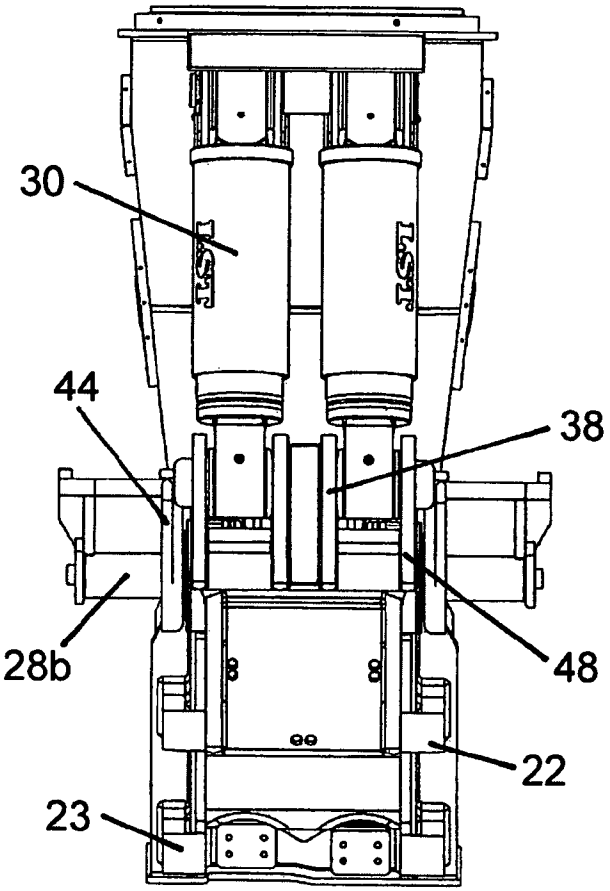
FIG. 6A shows a schematic side view of the attachment of FIG. 3 in the direction of the arrow B in FIG. 3 with extended pin parts.
Figure 6C:
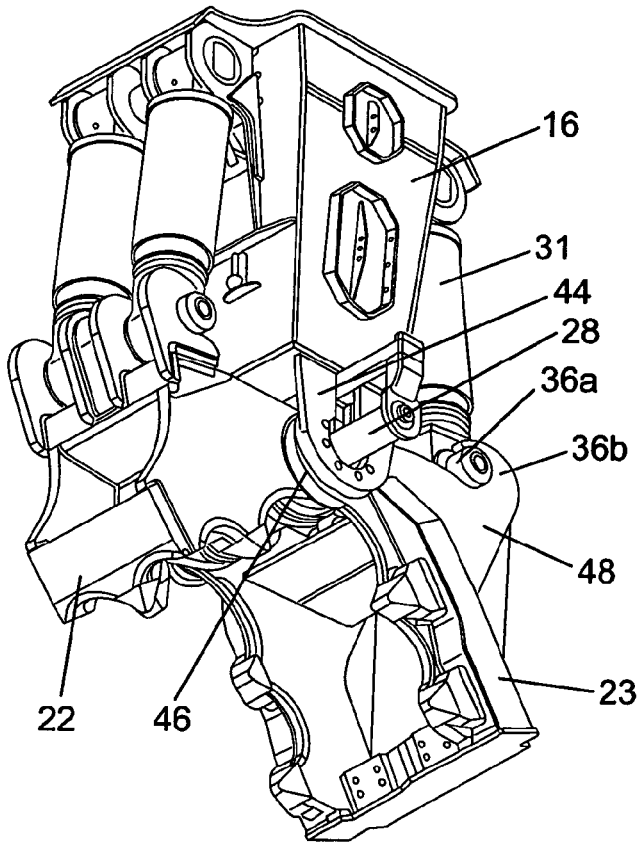
FIG. 6C shows a schematic perspective view of the attachment of FIG. 3 with extended pin parts.

While the two outer pin parts 28*b* are each arranged movably in their longitudinal direction, the middle pin part 28*a* is fixed to the frame 16 of the attachment 14. The movement of the outer pin parts 28*b* takes place via two drive elements of a pin drive 42. In this exemplary embodiment, the two drive elements of the pin drive 42 are in the form of hydraulic cylinders, the piston rods of which are securely connected to the outer pin parts 28*b* of the joint pin 28, as is shown in FIGS. 5B and 6B.

Optionally, other drive elements, such as electric motor drives for example, can also be used for the pin drive 42. Furthermore, only one common pin drive 42 can also be provided for moving the two outer pin parts 28*b*. The pin drive 42 is modified accordingly for differently divided pins 28.

Each of the two outer pin parts 28*b* is retained and guided in the frame 16 by an appropriately dimensioned and designed through-opening of a side cheek 44. The side cheeks 44 are preferably formed in one piece with the frame 16. The levers 38, 40 are mounted on the middle pin part 28*a* so that a defined movement of the two link devices 36 also takes place for the lifting cylinders 30, 31 when the tool parts 22, 23 are detachable.

Figure 5A:
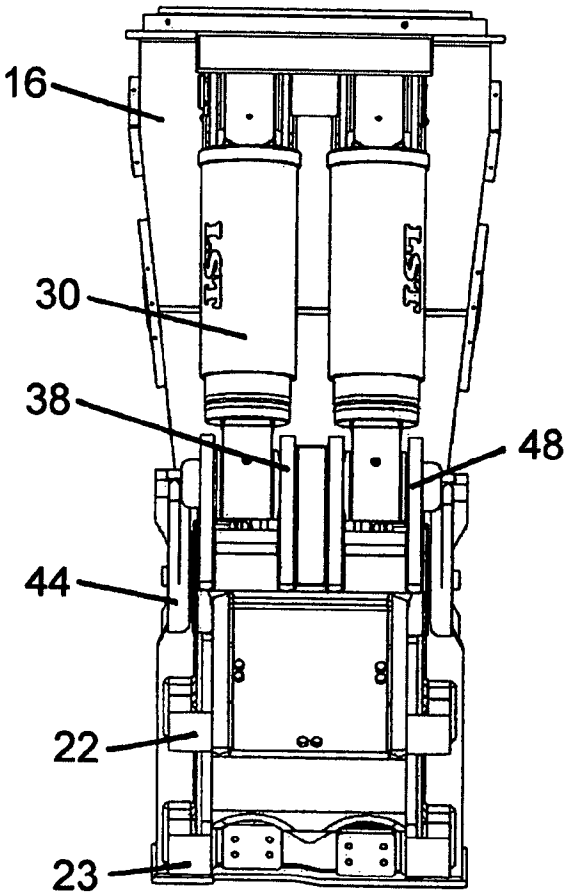
FIG. 5A shows a schematic side view of the attachment of FIG. 3 in the direction of the arrow B in FIG. 3 with retracted pin parts.

The two tool parts 22, 23 each have side cheeks 46 which are provided with through-openings, through which the outer pin parts 28*b* of the link pin 28 can be fed. When the pin is joined together by the pin drive 42, as is shown in FIGS. 5A and 5B, then the side cheeks 46 of the tool parts 22, 23 are pivotably mounted on the outer pin parts 28*b*. When the outer pin parts 28*b* are separated from the middle pin part 28*a* in opposite directions by the pin drive 42 (see FIG. 6A to C), then the side cheeks 46 of the tool parts 22, 23 can be removed from the joint 26 of the attachment 14 perpendicular to the longitudinal axis of the pin 28 (i.e. for example downwards in FIG. 6A).

In order to prevent accidental removal of the tool parts 22, 23 from the joint 26 of the attachment 14, the outer pin parts 28*b* are pre-stressed by the pin drive 42, preferably in their positions in which they are connected to the middle pin part 28*a*. As a further measure, the outer pin parts 28*b* can also be locked in these positions to retain the tool parts 22, 23.

In order to be able to completely remove the tool parts 22, 23 of the tool 18 from the rest of the attachment 14, the connections of the tool parts 22, 23 to the tool drive 20 via the second link devices 36 must also be removed. For this purpose, the second link devices 36 are made up of a first engagement element 36*a*, which is fixed to a lifting cylinder 30, 31 of the tool drive 20, and a second engagement element 36*b*, which is fixed to a tool part 22, 23 or formed in one piece therewith. The first and second engagement elements 36*a*, 36*b* are in each case detachably engaged with one another.

In this exemplary embodiment (cf. FIG. 6C), the tool parts 22, 23 each have side cheeks 48 which are designed with a hook-shaped second engagement element 36*b*. The side cheeks 48 are preferably designed in one piece with the side cheeks 46, which have the through-openings for the outer pin parts 28*b*. At their ends facing the tool parts 22, 23, the lifting cylinders 30, 31 each have a substantially bar-shaped first engagement element 36*a*. To remove the tool parts 22, 23 from the tool drive 20, the bar-shaped first engagement elements 36*a* can be moved in the direction perpendicular to their longitudinal axis out of the hook-shaped second engagement elements 36*b* in the side cheeks 48 of the tool parts.

The connection of these two link devices 36 is easily removed by actuating the tool drive 20, i.e. the lifting cylinders 30, 31. This sequence of movements is explained below with reference to FIG. 7A to G.

However, the second link devices 36 are not restricted to this embodiment only. For example, the first engagement elements 36*a* on the lifting cylinders 30, 31 can likewise be designed as pin-shaped engagement elements which can be slid in the direction of their longitudinal axis. In this case, the second engagement elements 36*b* are designed as cylindrical engagement elements, for example in the form of through-openings in the side cheeks 48 of the tool parts 22, 23. The removal of the connection of such a second link device 36 can take place, for example, in parallel with the removal of the link connection in that the pin drive 42 simultaneously moves the pin-shaped first engagement elements 36*a* of the second link devices 36.

Furthermore, the second link devices 36 can of course also be constructed with a reverse design of the first and second engagement elements. That is to say, for example, that the first engagement elements 36*a* on the lifting cylinders 30, 31 can also be designed in the shape of a hook, and the second engagement elements 36*b* on the side cheeks 48 of the tool parts 22, 23 can be designed in the shape of a bar.

In the present exemplary embodiment, the pin drive 42 is formed by hydraulic drive elements. In this case, in order to avoid a retrospective modification or conversion of the hydraulic system of implement 10 and/or equipment carrier 12, the pin drive 42 is likewise connected to the hydraulic supply lines of the attachment drive. Furthermore, a switch element (e.g. manual or remote-controlled, not shown) with which the supply lines between these two drives can be changed over, is provided on the attachment 14. As a rotary drive of the attachment 14 is not necessary during a tool change, this enables additional supply lines for the pin drive 42 to be dispensed with. A changeover of this kind is not necessary in the case of electric-motor-driven drive elements for the pin drive 42.

A description of a process for removing the tool 18 from the rest of the attachment 14, i.e. from the frame 16 and tool drive 20, now follows with reference to FIG. 7A to G. The fitting of the tool 18 to the frame 16 and to the tool drive 20 can be carried out in the correspondingly reverse order.

Figure 7A:
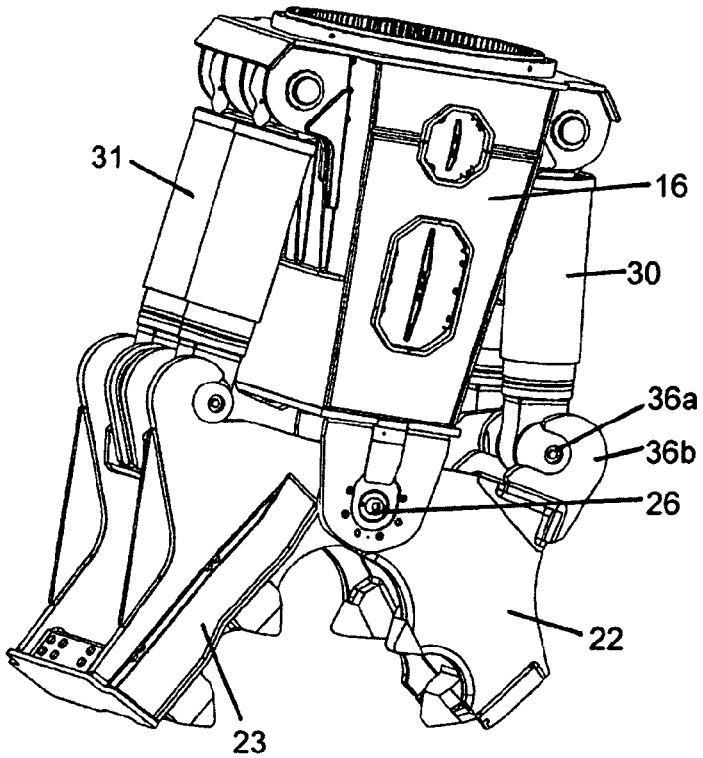
FIG. 7A to G shows various states of the attachment in perspective view in order to illustrate the process of removing the tool from the attachment.
Figure 7B:
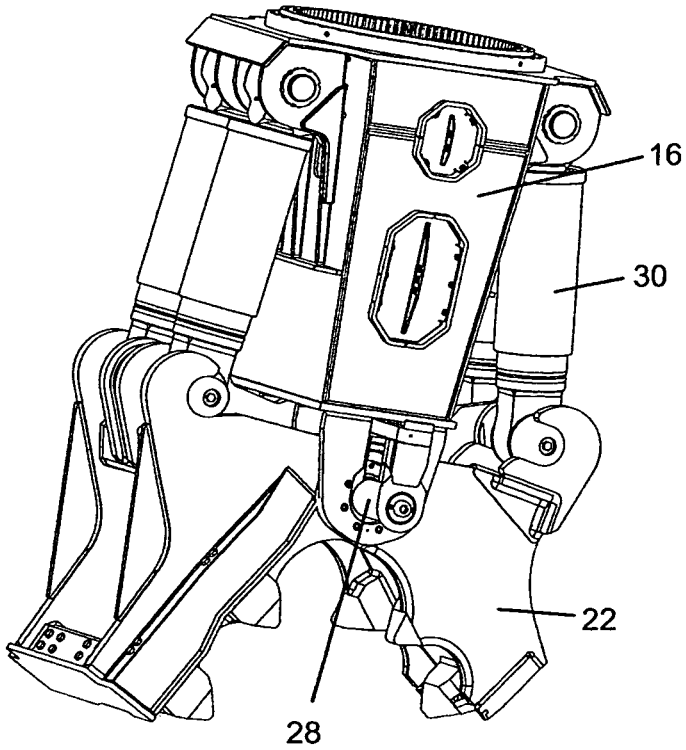

FIG. 7A first of all shows the initial state of the attachment 14 in which the tool parts 22, 23 are fixed to the frame 16 and to the tool drive 20 so that the attachment 14 is ready for use.

Figure 7C:
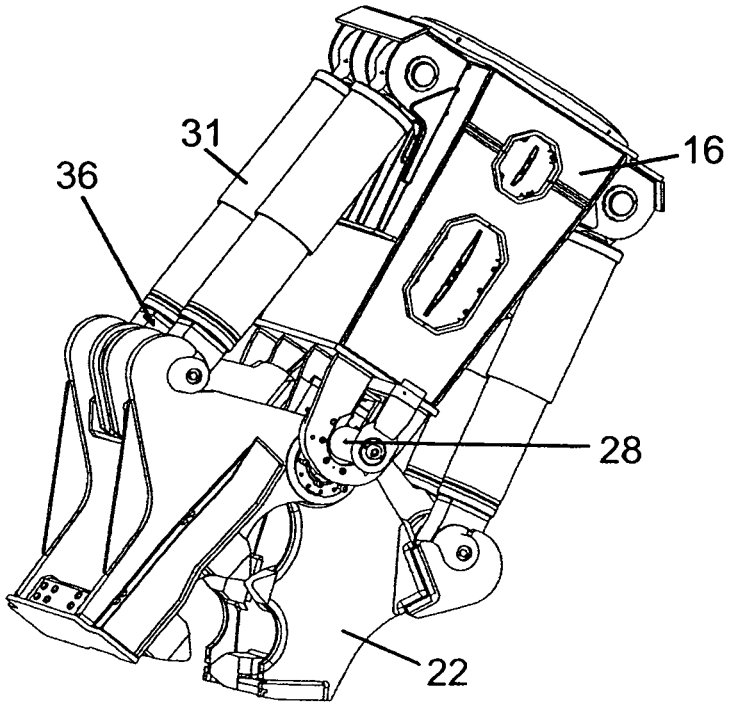

In a first step, the outer pin parts 28*b* are now removed from the joint 26 by means of the pin drive 42 (cf. FIG. 7B) after the drive supply lines have been changed over accordingly if necessary. When the two outer pin parts 28*b* have been fully withdrawn, the side cheeks 46 of the tool parts 22, 23 can be removed from the joint 26. As shown in FIG. 7C, this takes place in that the piston rods of the lifting cylinders 30, 31 are extended and therefore the frame 16 is pulled away from the tool 18.

Figure 7D:
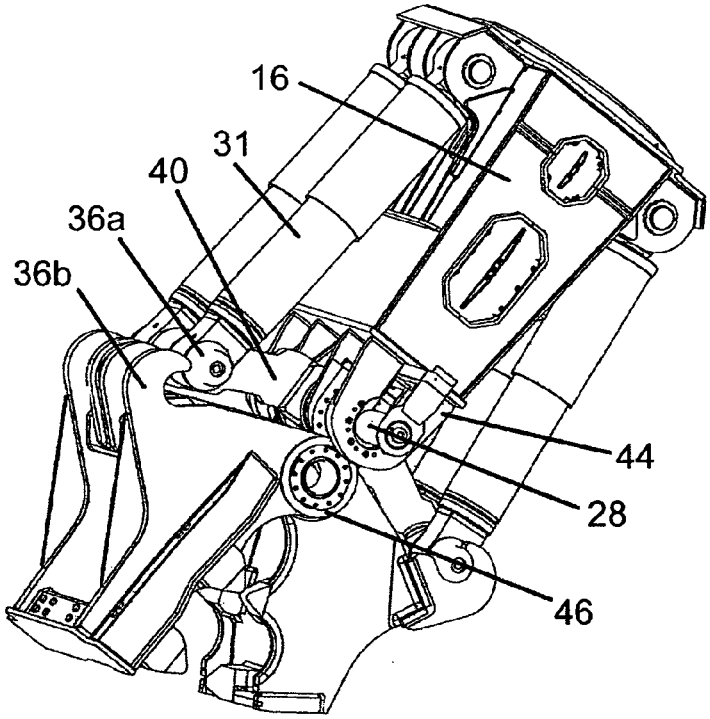
Figure 7E:
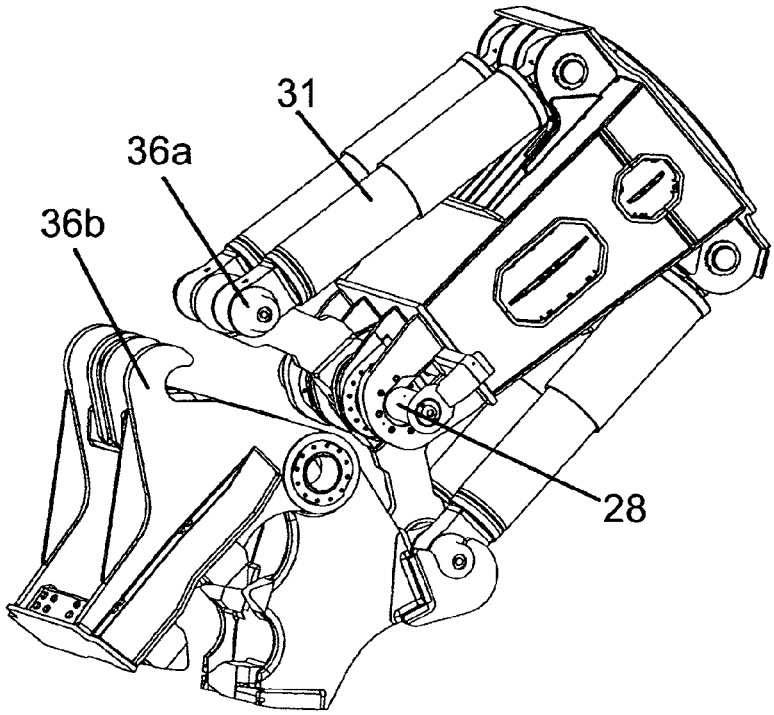

When the piston rods of the lifting cylinders 30, 31 are extended, the two tool parts 22, 23 are initially pivoted towards one another, as a result of which their side cheeks 48 with the hook-shaped second engagement elements 36*b* are moved apart. If, after the tool parts 22, 23 have been removed from the joint 26 of the frame 16, the piston rods of the lifting cylinders 30, 31 are now further extended as shown in FIG. 7D, then the bar-shaped first engagement elements 36*a* of the second link devices 36 on the one side (here for the second tool part 23) are initially withdrawn from the hook-shaped first engagement elements 36*b* on the appropriate tool part 23.

Figure 7F:
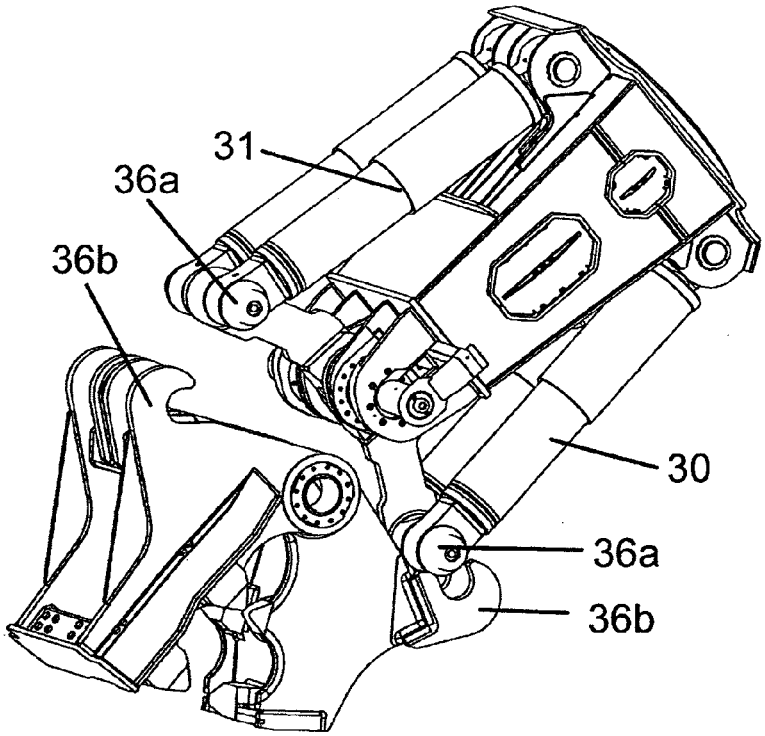

After the engagement elements 36*a*, 36*b* of the second link devices 36 on the one side have been completely separated from one another (cf. FIG. 7E), the frame 16 of the attachment 14 can be lifted slightly by means of the equipment carrier 12. In this way, the first and second engagement elements 36*a*, 36*b* of the second link devices 36 on the other side for the other tool part 22 can be separated from one another as shown in FIG. 7F.

Figure 7G:
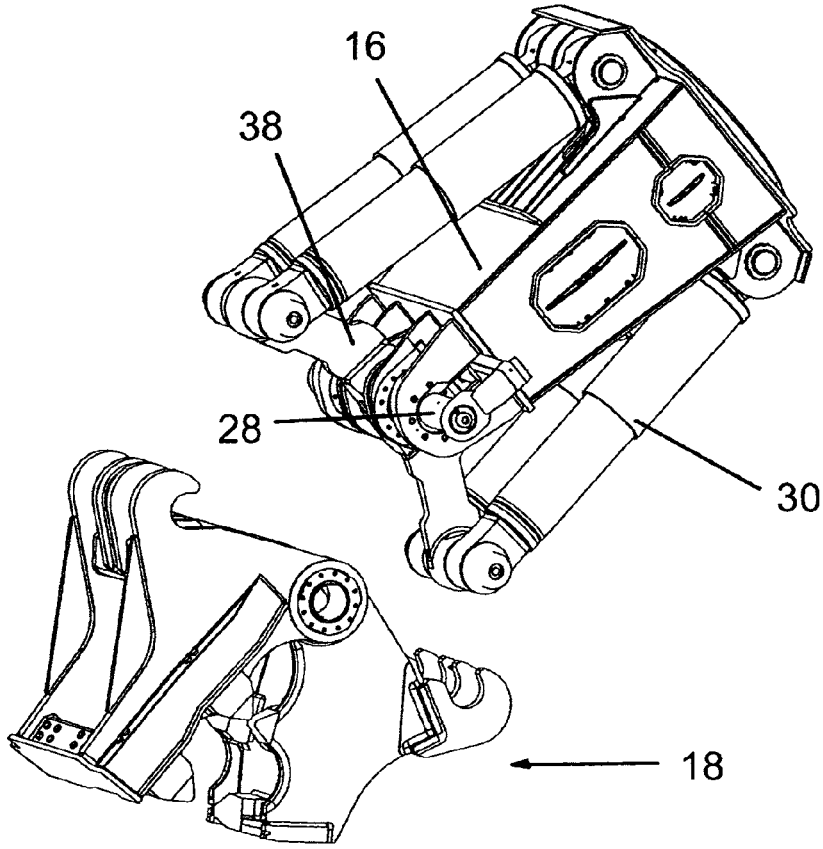

Finally, the frame 16 of the attachment 14 with the tool drive 20 fixed thereto can be completely separated from the tool 18 with the two tool parts 22, 23 (cf. FIG. 7G).

As the two tool parts 22, 23 of the tool 18 are now only in contact with one another in the area of their side cheeks 46 with which they were mounted on the joint 26, it can be of advantage to movably connect the two tool parts 22, 23 together in this area so that the tool forms a constructional unit and if necessary can be more easily transported and refitted.

In the exemplary embodiment described above, the second link devices 36 are connected via rigidly designed levers 38, 40 to the central joint 26 on the frame 16, and the first and the second engagement elements 36*a*, 36*b* of the second link devices 36 are separated from one another when the tool 18 is removed by means of the lifting cylinders 30, 31 of the tool drive 20. Alternatively, the levers 38, 44 guiding the movement of the second link devices 36 relative to the joint 26 can also be designed as adjustable-length levers.

In a similar manner to pin drive 42, the drive for changing the length of these adjustable-length levers can also, for example, have hydraulic and/or electric-motor-driven drive elements. In the case of hydraulic drive elements, these can be changed over to the hydraulic supply lines of the attachment drive in parallel with the supply of the pin drive 42.

When the attachment 14 is operated with coupled tool 18, these adjustable-length levers must have a predetermined fixed length so that a movement of the lifting cylinders 30, 31 leads to a pivoting of the tool parts 22, 23 about the joint 26. When the tool 18 is removed from the frame 16 and from the tool drive 20, the first and second engagement elements 36*a*, 36*b* of the second link devices 36 can then be removed from one another by changing the length of the adjustable-length levers.

In addition, play between the first and second engagement elements 36*a*, 36*b* of the second link devices 36, which can occur over the course of time, can be compensated for by the adjustable-length levers. This guarantees that the tool 18 remains securely fixed to the tool drive 20 in the long term.

The invention claimed is:

1. An attachment for construction machines, comprising:

a frame which can be attached via a coupling unit to an implement or to an equipment carrier of the implement;

a tool having two tool parts;

a joint that is provided on the frame and has a pin on which the tool parts of the tool can be pivotably mounted relative to one another; and a tool drive attached to the frame for moving the two tool parts relative to the frame;

wherein the tool drive is connected to the frame via at least one first link device, and the tool parts are detachably connected to the tool drive via respective second link devices;

wherein the pin of the joint can at least partially be removed from the joint by a pin drive provided on the frame in order to be able to remove the two tool parts from the joint and the frame;

wherein the second link devices of the tool drive each have a first engagement element provided on the tool drive and a second engagement element provided on a tool part, which second engagement element detachably engages with the first engagement element, wherein one of the first and second engagement elements includes a bar-shaped engagement element that can be removed from the other of the first and second engagement elements in a direction perpendicular to its longitudinal axis.

2. The attachment as claimed in claim 1, wherein the pin of the joint is formed by a plurality of pin parts which are detachably connected to one another in the longitudinal direction of the pin, of which at least one pin part can be removed from the joint by the pin drive.

3. The attachment as claimed in claim 2, wherein at least two pin parts of the pin can be removed from the joint by the pin drive.

4. The attachment as claimed in claim 3, wherein the pin drive has at least two drive elements which are designed for removing two pin parts of the pin from the joint in opposing directions.

5. The attachment as claimed in claim 1, wherein the pin drive is in the form of a hydraulic pin drive.

6. The attachment as claimed in claim 1, wherein the pin drive is in the form of an electric-motor-driven pin drive.

7. The attachment as claimed in claim 1, wherein a supply and/or control of the pin drive can be in the form of a supply or control of a drive of the attachment and/or the tool drive; and wherein a switch element is provided for switching over the supply or control.

8. The attachment as claimed in claim 1, wherein the detachable pin or detachable pin parts of the pin is/are prestressed in their position(s) in order to retain the tool parts.

9. The attachment as claimed in claim 1, wherein the detachable pin or detachable pin parts of the pin is/are lockable in their position(s) in order to retain the tool parts.

10. The attachment as claimed in claim 1, wherein the at least one second link device of the tool drive is connected to the joint via at least one rigid lever.

11. The attachment as claimed in claim 1, wherein the at least one second link device of the tool drive is connected to the joint via at least one adjustable-length lever.

12. The attachment as claimed in claim 11, wherein a supply and/or control of a drive for changing the length of the adjustable-length lever is formed by a supply or control of a drive of the attachment and/or the tool drive; and wherein a switch element is provided for switching over the supply or control.

13. The attachment as claimed in claim 1, wherein the other of the first and second engagement elements is designed as a hook-shaped engagement element.

14. The attachment as claimed in claim 12, wherein the tool drive, the pin drive and/or the drive for changing the length of the at least one adjustable-length lever is designed to effect a relative movement between the first and the second engagement element.

* * * * *